US006367184B1

(12) United States Patent
Kheder

(10) Patent No.: US 6,367,184 B1
(45) Date of Patent: Apr. 9, 2002

(54) SIGN

(76) Inventor: Alexandro A. Kheder, P.O. Box 230652, Astor Station, Boston, MA (US) 02123-0652

( * ) Notice: Subject to any disclaimer, the term of this patent is extended or adjusted under 35 U.S.C. 154(b) by 0 days.

(21) Appl. No.: 09/432,587

(22) Filed: Oct. 29, 1999

Related U.S. Application Data

(63) Continuation-in-part of application No. 09/145,601, filed on Sep. 2, 1998.

(51) Int. Cl.[7] ..... G09F 7/02
(52) U.S. Cl. ..... 40/617; 40/597; 248/206.2
(58) Field of Search ..... 40/597, 617, 907; 248/205.2, 205.3, 206.2, 475.1, 489

(56) References Cited

U.S. PATENT DOCUMENTS

| | | | | | |
|---|---|---|---|---|---|
| 1,632,856 | A | | 6/1927 | Running | 40/597 |
| 3,007,435 | A | | 11/1961 | Peterson | 116/28 |
| 4,257,342 | A | * | 3/1981 | Ditto | 40/600 |
| 4,471,873 | A | | 9/1984 | Thomas | 206/573 |
| 4,848,713 | A | * | 7/1989 | Adams | 248/206.2 |
| 5,334,361 | A | * | 8/1994 | Rafaelides et al. | 422/305 |
| 5,467,545 | A | * | 11/1995 | Zillner | 40/597 |
| 5,492,739 | A | | 2/1996 | Thorne et al. | 428/38 |
| D368,934 | S | | 4/1996 | Elmer | D20/42 |
| 5,595,364 | A | * | 1/1997 | Protz, Jr. | 249/206.2 |
| 5,692,331 | A | | 12/1997 | Tipke | 40/591 |
| 5,711,100 | A | | 1/1998 | Elmer | 40/592 |

* cited by examiner

*Primary Examiner*—Cassandra H. Davis

(57) ABSTRACT

The apparatus is a chosen body having messages and connected through a coupling with a single point of connection to a suction cup, the suction cup is suitable to mount onto solid surfaces.

9 Claims, 4 Drawing Sheets

SIGN

Figure 1:
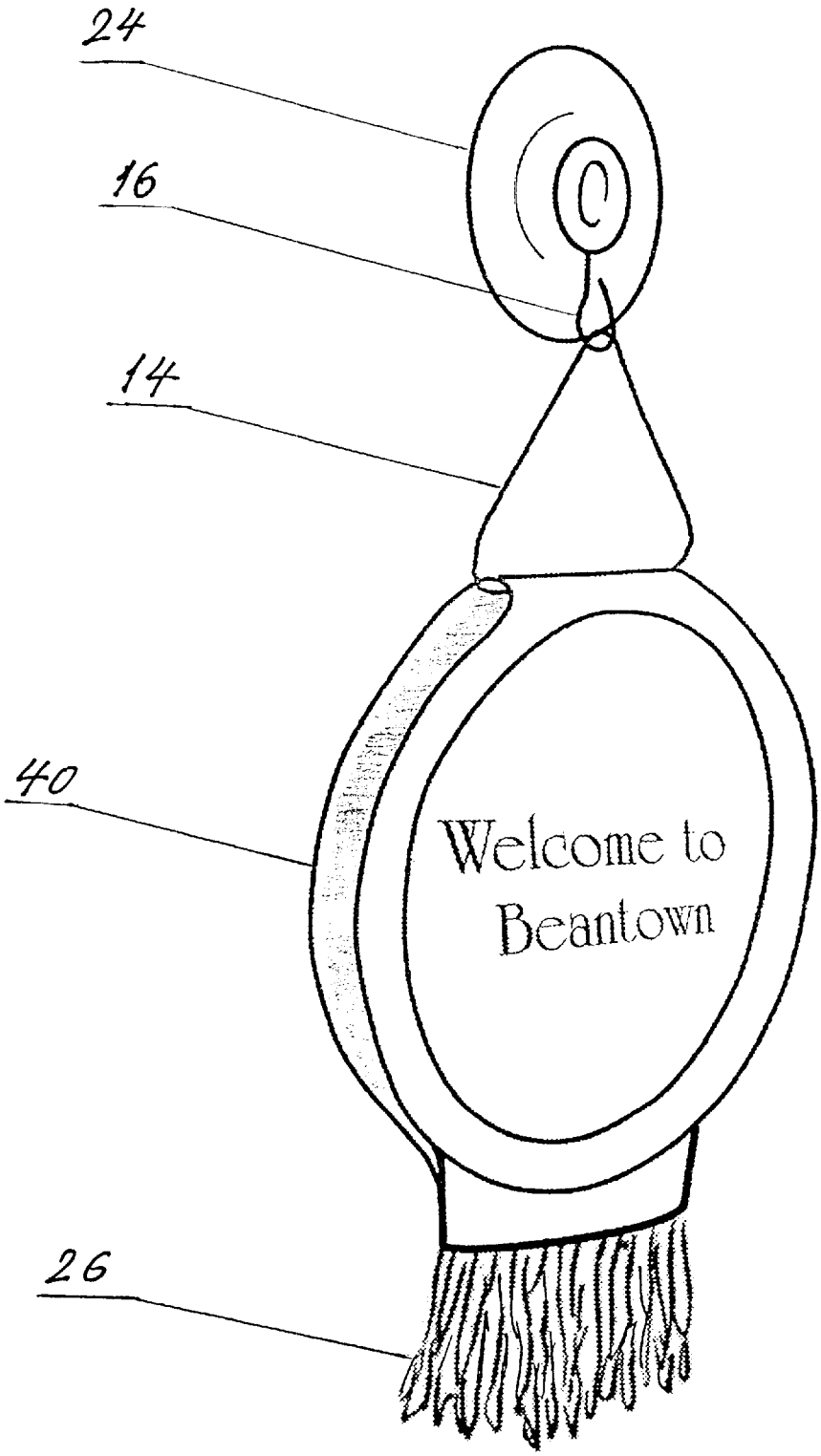

This is a continuation in part application for application Ser. No. 09/145,601 filing date of Original application: Sep. 2, 1998.

CROSS-REFERENCE TO RELATED APPLICATION

"NOT APPLICABLE"

STATEMENT REGARDING FEDERALLY SPONSORED RESEARCH OR DEVELOPMENT

"NOT APPLICABLE"

REFERENCE TO A MICROFICHE APPENDIX

"NOT APPLICABLE"

BACKGROUND OF THE INVENTION

The use of signs in automobiles and storefronts is being used and has been known for years. However, all prior art was built for the satisfaction of specific objectives which was very limiting in many ways.

This invention relates to advertising signs to be used in vehicles, store fronts and many other fields. The subject sign will deliver messages in a method substantially different from the conventional methods and designs of the existing art. Therefore, this design provides a novel idea developed for a very broad field of usage. Furthermore, it will be useful that a constant demand exists for a new idea that promotes and advertises messages and products. In this regard, the present invention comprehensively fulfills many needs and demands, where ideas that deliver messages as presented in this invention distinguishes from prior art, where this invention provides a wide array of usage and many methods of manufacturing. Prior art, whose usage was to display and deliver messages, in a method of fixing and or painting directly on objects. It also required skills and time for mounting and removing. The old methods of painting, nailing and gluing are known to leave damage to the properties they were affixed to. The present invention will eliminate all previous difficulties, and will be a great alternative to the old mentioned ways of general advertising such as bumper stickers. The prior art shows a number of signs and displays for a variety of purposes. None of which has the diversity and convenience of the present design, by method of example:

U.S. Pat. No. 5,692,331 to James Tipke.

U.S. Pat. No. 5,711,100 to William Elmer.

U.S. Pat. No. 268,120 to Daniel Kleiner of Germany.

U.S. Pat. No. 5,467,5452 to Zillner shows an assembly to determine the state of cleanliness of dishes in a dishwasher.

U.S. Pat. No. 3,007,435 to Peterson and presents a highway traffic safety signal.

U.S. Pat. No. 4,471,873 to Thomas and presents a distressed flag kit for motorists.

BRIEF SUMMARY OF THE INVENTION

In awareness of the forgoing disadvantages in existing signs, as well as prior art, the present design offers an efficient and practical concept to advertise and expose messages and products. This design, as well as a method of a detailed assembly to be presented, will show greater advantages than all prior art and none of the disadvantages, and it will be described at a later point in greater depth. A swinging sign that is easily mounted and removed and made possible to swing freely by its own weight in a pendulum like motion; and comprises of a body made of soft or rigid material in a variety of shapes and sizes; a suction cup that is formed of rubber like material and consists of an inner section, and the outer section is a nipple protruding ⅛ of an inch of the back of the suction cup to create a circular groove suitable for hanging a wire loop or any similar devise thereof, a coupling that connects the sign to the suction cup with a single link in between. Messages will be printed, painted, embroidered, embossed and/or pressed, and dark reflective phosphoric and neon materials will also be used for night visibility. The sign will be made of any desired shaped body (round, square, etc..) and will deliver a variety of messages in an assortment of shapes and styles to represent products, services and organizations. The sign will be made of textiles, plastic, metal, wood and paper products.

THE DRAWINGS

FIG. 1: A realistic view of the sign.

Figure 2:
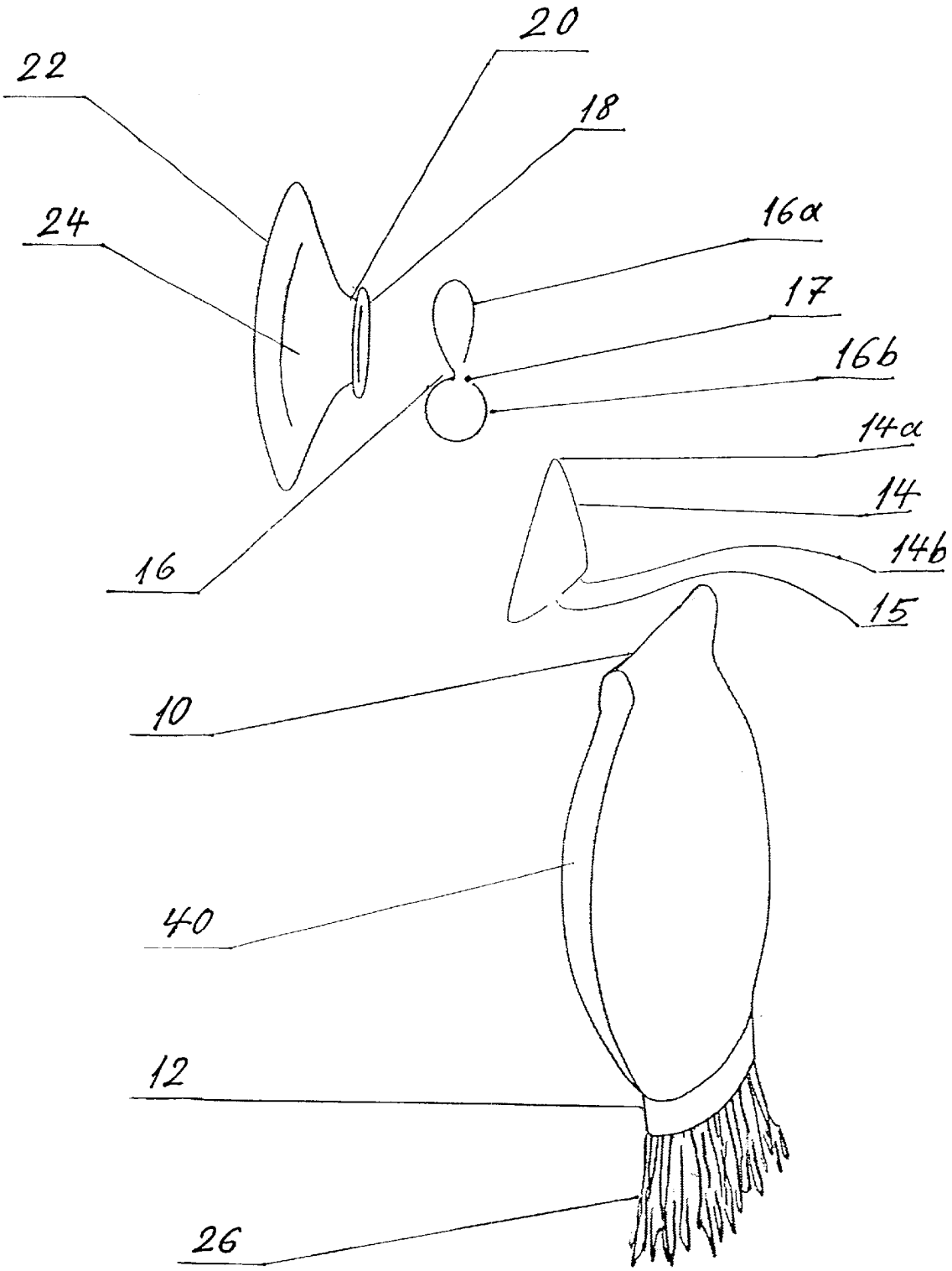

FIG. 2: A detailed illustration of the components of the sign.

Figure 3:
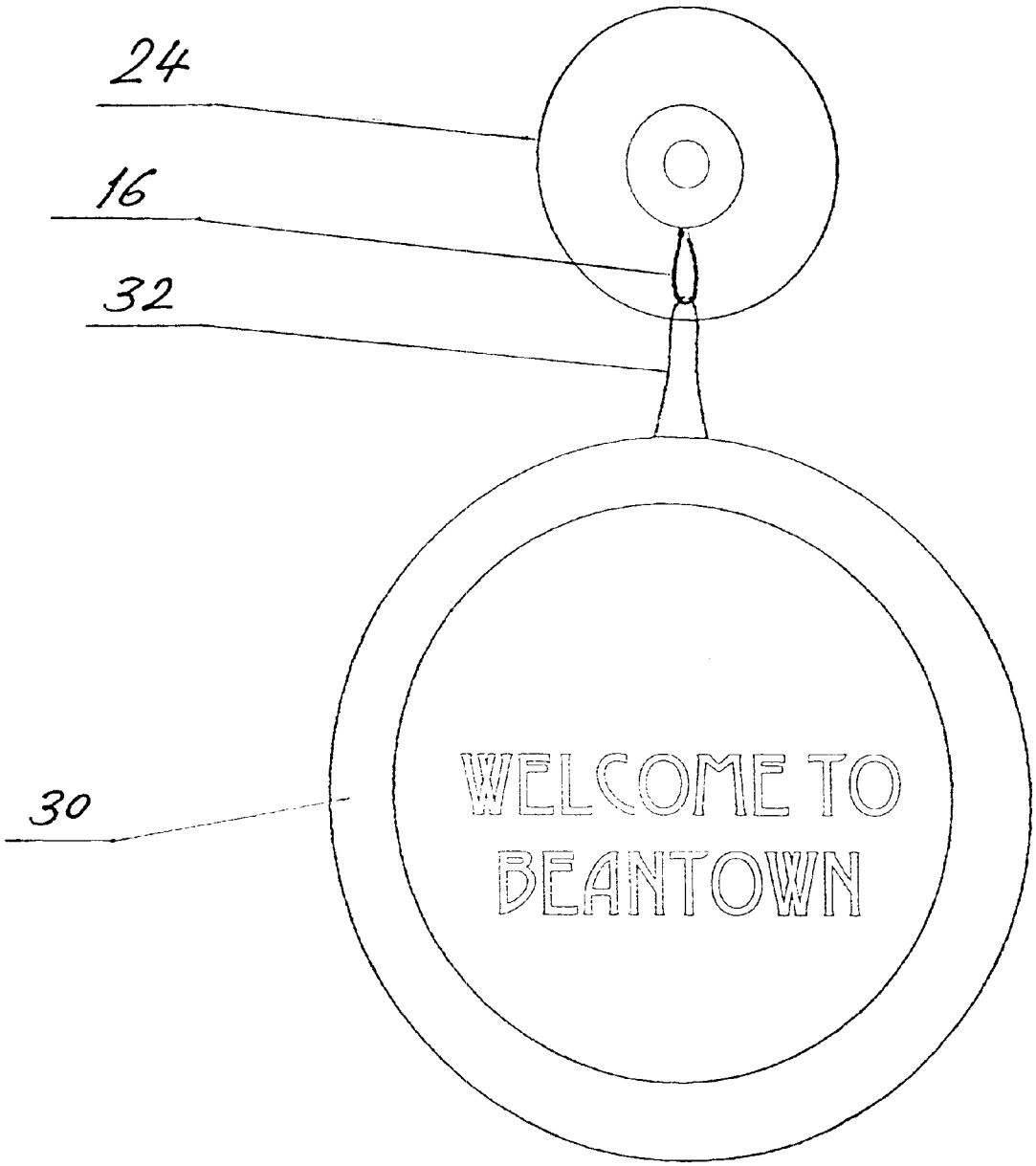

FIG. 3: Alternate embodiment made of a rigid body.

Figure 4:
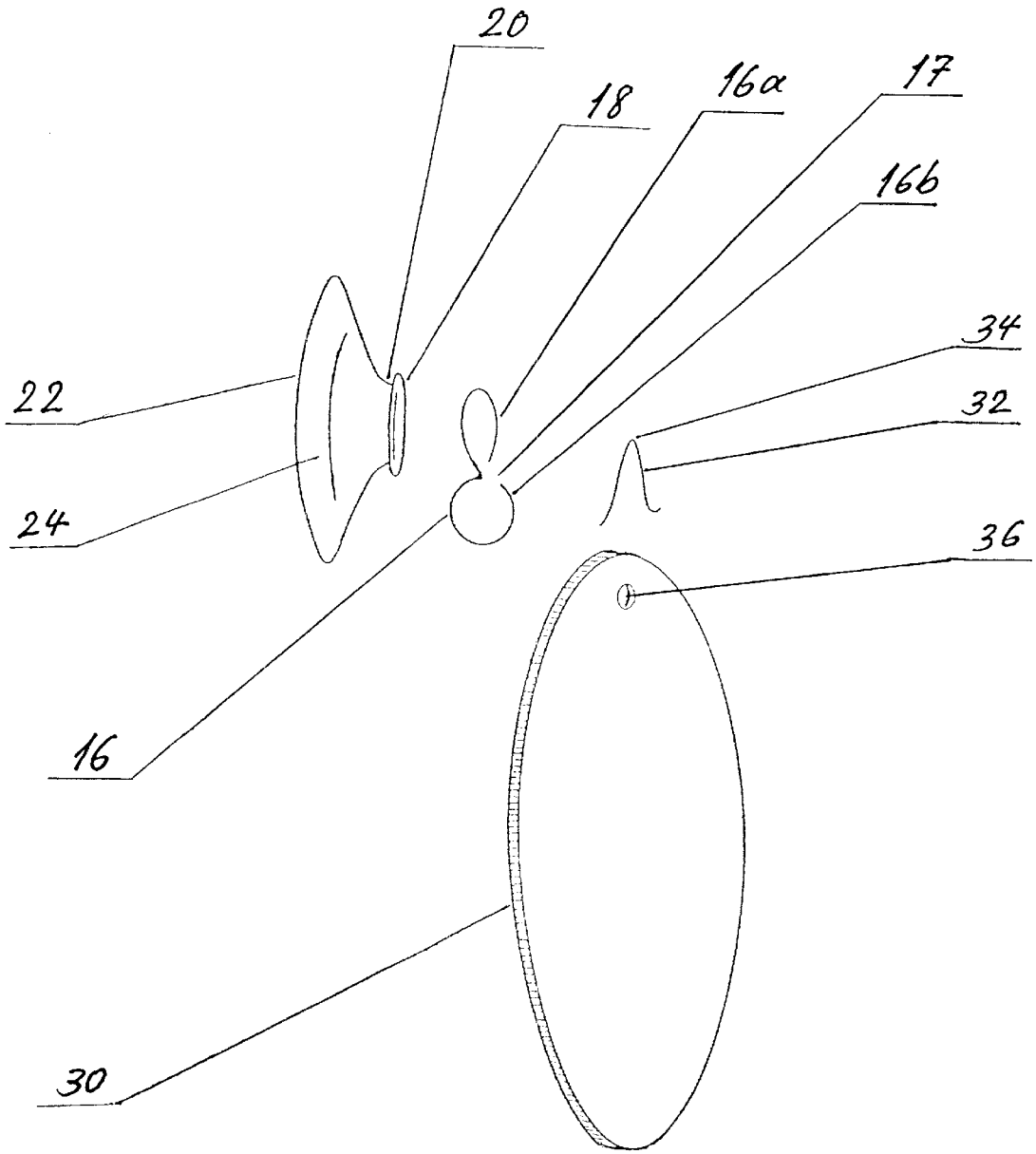

FIG. 4: A detailed illustration of the components of the alternate embodiment.

DETAILED DESCRIPTION OF THE INVENTION

The chosen embodiment of the present invention will have a sign hanging from its top end and left loose at the lower end to swing in reaction to any movements to its surroundings, and will be described referring to FIGS. 1–4. FIG. #1 shows a full realistic image of the subject sign, and FIG. 2 shows all parts of the subject sign. In its broadest of terms, the invention comprises of the sign 40, a suction cup as a method of mounting means 24, a double eyelet 16 and hanging bracket 14, the double eyelet and the hanging bracket are operatively linked there between to form a coupling means. In more detail, the sign 40 made of flexible material (laminated paper in this case) where a round shaped sign is achieved by forming two round shape bodies joined at their top end 10 and folded at that point, the two loose ends 12 of the two round bodies are then joined together using adhesive, stitching, stapling or any other familiar means of fastening.

A mounting means shown as a suction cup 24 is formed of a flexible material with two sections, an inner section 22 is generally spherical in shape with a periphery suited to contact solid surfaces by suction by applying pressure thereagainst, and the outer section is a nipple 18 protruding ⅛ of an inch from the suction cup to create a circular groove 20 adapted for attaching a wire loop or any similar device thereof. Other mounting means are achieved with the use screws, nails, clips, brackets, hooks, magnets, adhesives or any adaptable mounting material which will perform the task of mounting.

A coupling means for connecting the body to the mounting means, said coupling means having two parts coupled together with a single link in upper and lower positions respectively, the upper part being configured to attach firmly around the groove of the mounting means by means of an eyelet or the like, the lower part being connected by the single link to the eyelet and the body to enable the body to hang from the link between the upper and lower parts, the single link being the sole point of connection between the mounting means and the body, thereby allowing the body to move in reaction to movements in its surroundings. The lower part is a bracket device 14 formed in a triangular shape or any similar device that would perform the same, with its bottom end horizontal **14*b* with an opening 15 and runs through the folded top end of the subject sign, and the top angle of the bracket device pointing upwardly 14***a*. This bracket can be replaced by any other means or devices that would perform the same desired function. The upper part is a form of double eyelet 16 with a 90 degree angle between the loops at the center point, this double eyelet to be set in a vertical position, where the top eyelet 16*a* sits upwardly and set to loop around the groove 20 of the suction cup tightly, and the bottom eyelet 16*b* sits downward and will act as a hook where the sign will hang from, through an opening 17. The top angle 14*a* of the hanging bracket 14 will hook onto the bottom eyelet 16*b*, through the opening 17, the top eyelet 16*b* connects to a suction cup 24 by looping around the groove 20 of the outer section of the suction cup tightly. Another alternate embodiment is shown in FIG. 3 and described in detail in FIG. 4, where the sign is made of a rigid material 30 using a coupling with a single link, the said coupling connects the body to the suction cup, said coupling having a bracket 32 that attaches to the center of the sign's top end by stapling or other means of affixing, the bracket 32 has a top angle 34 and will operatively link to the double eyelet device 16 from the bottom eyelet 16*b* through the opening 17, where the top eyelet 16*a* loops around the suction cup's groove 20. This embodiment is also achieved by hanging a rigid body 30 through a hole 36 at the balanced center of the body's top end in a variety of ways, this hole is large enough to allow the sign to move freely by hanging from the bottom loop 16*b* of the double eyelet device 16 through the opening 17, the top loop 16*a* of the device 16 attaches to a suction cup 24 by looping around the groove 20.

An alternate design is shown in FIG. 1, in such design, supplemental accessories are provided for decorative purposes to improve the overall look of the design, such accessories will include, but not be limited to, tassels 26 that attach to the bottom end and/or the boarders of the sign, bells, also decorative boarders can be applied, as needed, using any suitable means of affixing.

The subject sign will have many shapes and sizes depending on specific needs, where the number of shape and size designs is limited only by the users imagination and the need for a specific shape and /or size, where the subject could be a square, a circle, a star, a tiger face or a soccer ball or any other desired specific shape, and also ranging in measurements that range from small to big and any where in between, which provides a great advantage in many fields. Another great feature is demonstrated in the ability of making the subject of a variety of materials such as wood or any wood products, plastic or any plastic products, fiberglass, fibers, fabric or any textile products, paper or any paper products, metal or any favorable materials which are suitable to be used for this novel idea and would satisfy the specific needs (FIG. 1 is made of laminated paper, and FIG. 3 is made of cardboard).

The general method of advertising with this invention is through any known method of mass reproduction, embroidery, and numerous other ways of printing, embossing, painting, image reproduction, pressing, itching and any methods of coloring on the front and back faces of the body, also illumination is achieved using reflective phosphoric, neon or similar materials that will provide an efficient way for night exposure.

Replacement and change of this design for improvement purposes is never a concern due to its efficient economical value. The sign could be mounted primarily by the use of suction cups, also by screws, nails, magnets, clips, hooks, adhesives or any adaptable mounting methods, depending on the specific needs and requirements. This design will be used to deliver messages for any need in many fields as well as numerous products, services, schools, companies and organizations, including but not limited to, sports, politics, food products, company and organization logos, flags, promotions, social and political messages and any other unlimited need to expose anything for any purpose in any field. The subject will deliver the same message or print on both sides, or two different messages one on each side, if desired, as well as a message at least on one side only or any combination thereof as the need may require. The sign would vary in size and shape as needs dictate where this variety will accommodate a broader range of needs and usage. This sign will have many decorative additions to improve the quality of the finished product, such as tassels, boarders or the like. The subject could also be used as a form of a swinging frame when made of solid material, such as: wood, plastic or metal. Another advantage of the suggested design is creating a scented body by impregnating the chosen body with scents using fragrances, air freshener, oils, herbs, aroma therapy products, natural essences, artificial essences and many other similar products available on the market to create a scented body which will be used for many reasons in many places. Also another embodiment is achieved by creating a three dimensional body, When a rigid body is utilized a desirable third dimensional thickness is added as a part of the embodiment's design, and when a flexible body is utilized, the body could be adapted to be filled with a any suitable soft material to create a form of stuffed body.

While specific embodiments of the present invention have been shown and described in detail to illustrate the application of the principles of the present invention, it will be understood that the present invention may be embodied otherwise without departing from these principles. Therefore, the spirit and scope of the appended claims should not be limited to the description of preferred embodiments contained herein.

Because many varying and differing embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense. All measurements, materials, connecting devices, and methods of operation used can be adjusted, altered or reshaped to fit certain needs and should not be regarded as a fixed guideline. Many adjustments to this design may be applied by adding or reducing the number of connecting parts without departing from the scope of the invention. Any specific and descriptive phrases, language, terminology and illustrations should not limit the scope of the invention. It must be understood that the primary dimensional relations for all elements of the invention include variations in functions and manner of operation, size, shape, materials, form, assembly and use are considered obvious to those skilled in the business; and all similar relationships to the matter shown in the drawings and described in the specifications are meant to be covered by the present invention.

What is claimed as being new and desired to be protected by LETTERS PATENT of the United States is as follows:

1. A hanging sign comprising:

a body of a selected geometrical shape up to 12 inches in size with surfaces suited for displaying messages, where a round shaped sign is achieved by forming two round shape bodies joined at their top end and folded at that point leaving the surfaces with the message to the outside and the opposite loose ends from the top of the two round bodies are then joined together creating the bottom end of the sign, and the body is adapted to hang freely only from its top end at a sign point of connection, leaving the rest of the body free of any constraints to enable the body to move in reaction to any movements in its surroundings, a mounting means of elastic nature with an inner section and an outer section, the inner section being hemispheric in shape adapted to attach to solid surfaces when pressure applied thereagainst, and the outer section having a protruding nipple which creates a groove adapted for objects to attach firmly to, a coupling means for connecting the body to the mounting means, said coupling means having an upper part linked to a lower part at a single connection point, the upper part having a top loop and a downward loop and the lower part is a triangular bracket with its apex positioned upward and the the base positioned downward, the bracket is suitable to hold the body of the sign, where the upper part of the coupling means being configured to attach firmly around the groove of the mounting means through the top loop, and downward loop positioned downward at a right angle with the top loop, the triangular bracket hangs at the apex from the downward loop of the upper part where the base is adapted to hold the body, the bracket connects to the downward loop of the upper part at the single connection point, where the single connection point being the sole point of connection between the mounting means and the body, thereby allowing the body to move freely in reaction to movements in its surroundings; and supplemental attachments of decorative nature are added to the body of the sign.

2. The sign of claim 1 wherein said body is made of a rigid body.

3. The sign of claim 1 wherein said body is made of a flexible body.

4. The sign of claim 1 wherein said body has a message at least on one surface.

5. The sign of claim 1 wherein said body has messages on all surfaces.

6. The sign as claimed in claim 1 where sign is three dimensional.

7. The sign of claim 1 wherein said body is suitable to utilize printing, pressing, embroidery, drawing, embossing and image reproduction.

8. The sign of claim 1 wherein said body utilizes neon and phosphoric finish.

9. The sign of claim 1 wherein said body is scented.

* * * * *

UNITED STATES PATENT AND TRADEMARK OFFICE

CERTIFICATE OF CORRECTION

PATENT NO. : 6,367,184 B1
DATED : April 9, 2002
INVENTOR(S) : Khender

It is certified that error appears in the above-identified patent and that said Letters Patent is hereby corrected as shown below:

Column 4,
Line 64, change “a sign” to -- a single --.

Signed and Sealed this

Twenty-fourth Day of December, 2002

JAMES E. ROGAN
*Director of the United States Patent and Trademark Office*